US006594460B1

(12) United States Patent
Williams et al.

(10) Patent No.: US 6,594,460 B1
(45) Date of Patent: Jul. 15, 2003

(54) LOW FORCE LATERAL PHOTORECEPTOR OR INTERMEDIATE TRANSFER BELT TRACKING CORRECTION SYSTEM

(75) Inventors: Lloyd A. Williams, Mahopac, NY (US); Vittorio Castelli, Yorktown Heights, NY (US); Joannes N. M. deJong, Hopewell Junction, NY (US); Elias Panides, Whitestone, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/241,230

(22) Filed: Sep. 10, 2002

(51) Int. Cl.[7] ..... G03G 15/00

(52) U.S. Cl. ..... 399/165; 198/810.03; 198/814; 399/162

(58) Field of Search ..... 399/162, 165, 399/167; 198/804, 807, 810.03, 810.02, 814

(56) References Cited

U.S. PATENT DOCUMENTS 5,233,388 A 8/1993 Reese et al.
5,316,524 A 5/1994 Wong et al. ..... 474/151
5,383,006 A 1/1995 Castelli
5,467,171 A 11/1995 Castelli et al.
5,510,877 A 4/1996 deJong et al. ..... 399/165
5,697,608 A 12/1997 Castelli et al.
6,195,518 B1 2/2001 Bennett et al.

*Primary Examiner*—Susan S. Y. Lee
*Assistant Examiner*—Candice C. Campbell

(57) ABSTRACT

In a printing system in which a rotatable print image bearing belt is mounted on at least one axial belt roller, and the belt must be maintained in a desired substantially consistent lateral registration to maintain image quality, the lateral misregistration of the belt is sensed and a low and substantially constant lateral positional corrective force is applied to the belt in response to the sensing of the lateral misregistration in one of the two directions axial of the axial belt roller for at least one complete rotation of the rotatable print image bearing belt, the low and substantially constant transverse corrective force having a force level sufficient to provide the desired substantially consistent lateral registration of the print image bearing belt.

7 Claims, 4 Drawing Sheets

LOW FORCE LATERAL PHOTORECEPTOR OR INTERMEDIATE TRANSFER BELT TRACKING CORRECTION SYSTEM

Disclosed in the embodiments herein is an improved system for accurately maintaining the correct lateral position for imaging of rotating xerographic photoreceptor belts or other printing system image bearing belts, including intermediate image transfer belts, with various advantages over prior such so-called "belt tracking systems" or the like, as explained herein.

In particular, there is disclosed in the embodiments herein an improved, low cost and simple system for accomplishing the above and other advantages. Improved photoreceptor and/or intermediate belt tracking is particularly desirable to reduce lateral registration errors between color separations in color printing. In these embodiments the belt lateral position is sensed and automatically controlled by belt edge guides, but the belt edge guides do not have fixed positions. Instead of fixing their positions, the belt edge guides act on the belt edges with a relatively constant and low lateral force, the low level of which force may be adjusted slowly, but is sufficient to maintain the belt in the desired average lateral position. The magnitude of the maximum applied belt edge force is low as compared to other belt edge guide belt control systems. This reduces belt wear, etc. Yet, belt profile induced belt rotation fluctuations can also be significantly reduced. Belt rotation fluctuations can introduce mixed color printing skew registration errors.

With the addition of an extra color to a printer, even for a black and white printer, color-to-black registration became an important issue. The latent image for black and color may be generated at different (opposite parts) of the belt. Therefore, accurate belt tracking is important to ensure color-to-black registration. However, the advantages of the belt tracking system of the disclosed embodiment are also applicable for full color printing and many other belt tracking applications. Those relative advantages over some other belt tracking systems can include lower cost as compared to active (power driven) steering systems, with no induced belt skew, and substantially less edge force (as well as no induced belt skew) as compared to conventional belt edge guide systems. This can increase belt life significantly.

Furthermore, the disclosed embodiments are more easily retrofitted as an improvement in existing printers than are active steering or roller pivoting steering systems. In particular, the disclosed embodiment can more easily enable the conversion of a single color (black only) printer to a highlight color machine with less change to the photoreceptor mounting or module.

The disclosed embodiments can even accomplish the accurate maintaining of a substantially constant lateral belt position with only a simple low applied spring force system, of a low force level which may be set to only slightly above the force level needed to overcome the average force required to overcome the other steering effects of the belt system (i.e. the mechanical errors induced by the belt's plural mounting rollers, etc.).

By way of background, various types of prior "belt tracking systems" and belt edge guides are known in the art for maintaining and controlling the position of rotating xerographic photoreceptor belts, including lateral belt guidance to obtain good color registration in color printing. The following Xerox Corporation U.S. patent disclosures are noted by way of some examples, in particular, U.S. Pat. No. 5,383,006 issued Jan. 17, 1995 to V. Castelli; U.S. Pat. No. 5,316,524 issued May 31, 1994 to C. Wong, et al, and also U.S. Pat. No. 6,195,518; 5,233,388; and 5,467,171.

Many of the prior belt tracking systems, such as disclosed in said U.S. Pat. No. 6,195,518 or in Xerox Corporation U.S. Pat. No. 4,061,222, 4,174,171, 4,344,693, 4,572,417, or 4,961,089, use active belt roller axis pivoting or "tilting" systems. However, these tend to add complexity and cost, among other issues as noted herein.

A specific feature of the specific embodiments disclosed herein is to provide a printing method in which a rotatable print image bearing belt is mounted on at least one axial belt roller, and said rotatable print image bearing belt must be maintained in a desired substantially consistent lateral registration to maintain image quality; the lateral misregistration of said rotatable print image bearing belt is sensed and a low and substantially constant lateral positional corrective force is applied to said rotatable print image bearing belt, in response to said sensing of said lateral misregistration of said rotatable print image bearing belt, in one of the two directions axial of said axial belt roller, for at least one complete rotation of said rotatable print image bearing belt, said substantially constant transverse corrective force having a force level sufficient to provide said desired substantially consistent lateral registration of said print image bearing belt.

Further specific features disclosed in the embodiments herein, individually or in combination, include those wherein said low and substantially constant lateral positional corrective force is applied in the same direction for plural said rotations of said image bearing belt; and/or wherein said low and substantially constant lateral positional corrective force is applied indirectly through a low spring constant spring system; and/or wherein said low and substantially constant lateral positional corrective force is applied by a servo system with a low bandwidth corresponding to plural said rotations of said image bearing belt; and/or wherein said spring system has first and second spring components, and further including a reversible and low bandwidth drive motor acting with more force on said first spring component than said second spring component to provide said low and substantially constant lateral positional corrective force; and/or wherein said low and substantially constant lateral positional corrective force is applied indirectly through a low spring constant spring system, wherein said spring system has first and second spring components, and further including a reversible and low bandwidth drive motor acting with more force on said first spring component than said second spring component to provide said low and substantially constant lateral positional corrective force; and/or wherein said print image bearing belt is mounted on said at least one axial belt roller between first and second non-rotating belt edge guides, and said low and substantially constant lateral positional corrective force is applied to at least one of said first and second non-rotating belt edge guides; and/or wherein said first and second non-rotating belt edge guides are connected together by a linking system for common lateral movement in the axial direction of said axial belt roller, and said low and substantially constant transverse positional corrective force is applied thereto; and/or a printing apparatus in which a rotatable print image bearing belt is mounted on at least one axial belt roller, and said print image bearing belt must be maintained in a desired substantially consistent lateral registration to maintain image quality, the improvement comprising means for sensing lateral misregistration of said rotatable print image bearing belt, and means for applying a low and substantially constant lateral positional corrective force to said image bearing belt in the axial direction of said axial belt roller for more than a complete rotation of said image bearing belt, said substantially constant lateral positional corrective force having a force level sufficient to maintain said desired substantially consistent lateral registration of said rotatable print image bearing belt; and/or wherein said rotatable print image bearing belt is mounted on said at least one axial belt roller between first and second non-rotating belt edge guides, and said low and substantially constant lateral positional corrective force is applied to at least one of said first and second non-rotating belt edge guides; and/or wherein said first and second non-rotating belt edge guides are connected together by a linking system for common lateral movement in the axial direction of said axial belt roller, and said low and substantially constant transverse positional corrective force is applied thereto.

The terms "reproduction apparatus" or "printer" as used herein broadly encompasses various printers, copiers or multifunction machines or systems, xerographic or otherwise, unless otherwise defined.

As to specific components of the subject apparatus or methods, or alternatives therefor, it will be appreciated that, as is normally the case, some such components are known per se in other apparatus or applications, which may be additionally or alternatively used herein, including those from art cited herein. For example, it will be appreciated by respective engineers and others that many of the particular components, component mountings, etc., illustrated or described herein are merely exemplary, and that the same novel motions and functions can be provided by other known or readily available alternatives. All cited references, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific apparatus and its operation or methods described in the examples below, and the claims. Thus, the present invention will be better understood from this description of these specific embodiments, including the drawing figures (which are approximately to scale) wherein:

Figure 2:
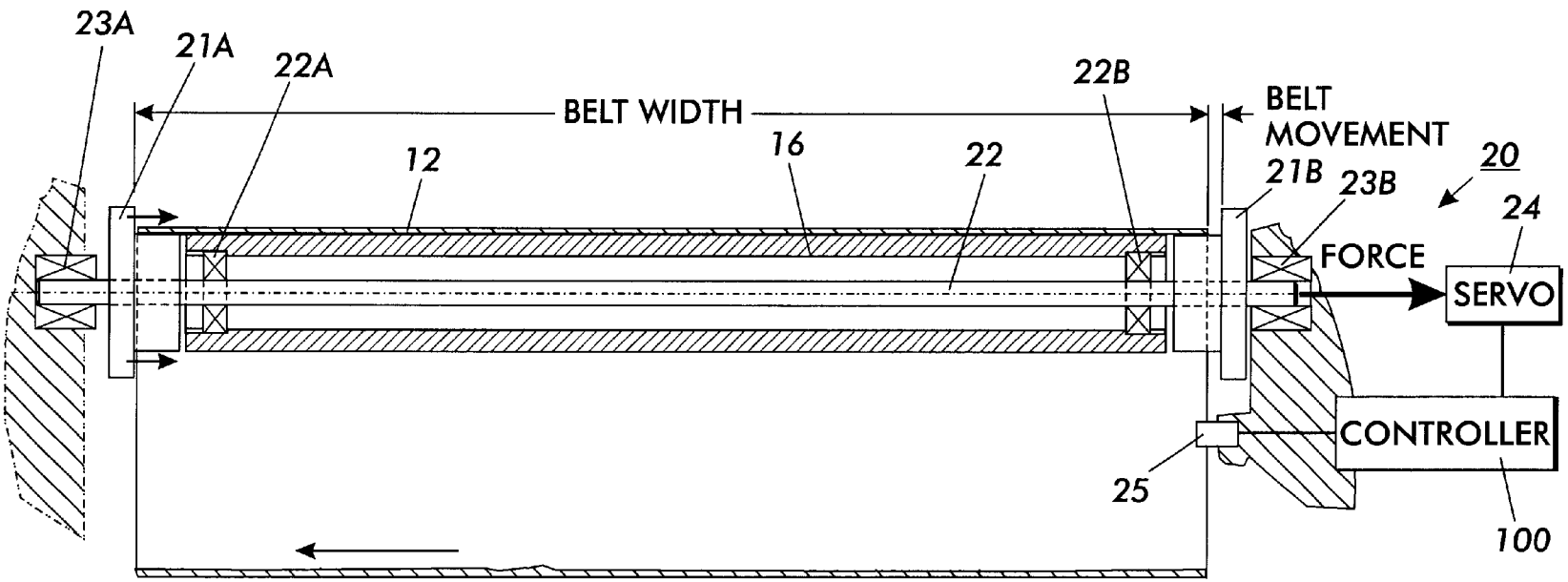
FIG. 2 is an axial cross-sectional view of an exemplary photoreceptor belt supporting roller (as in FIG. 1) and one example of an integral belt tracking system, the example here utilizing a low rate, low belt force applying, solenoid.
Figure 3:
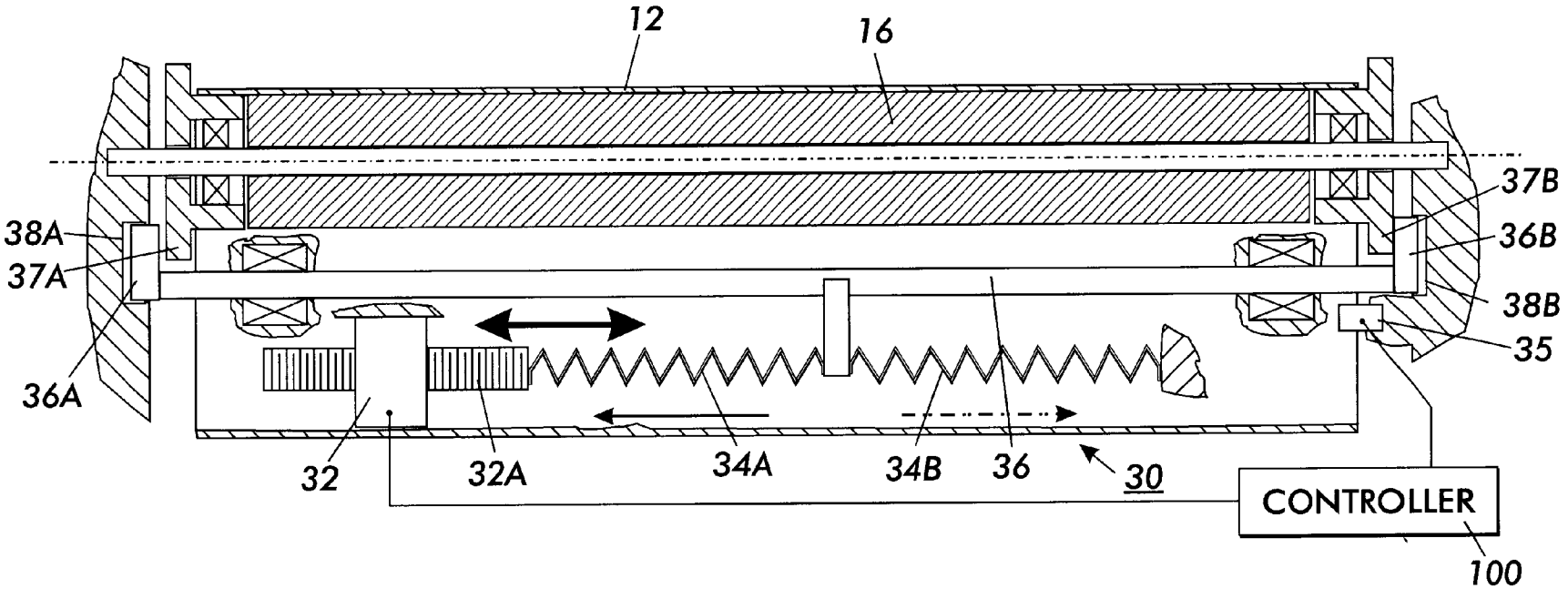
Figure 4:
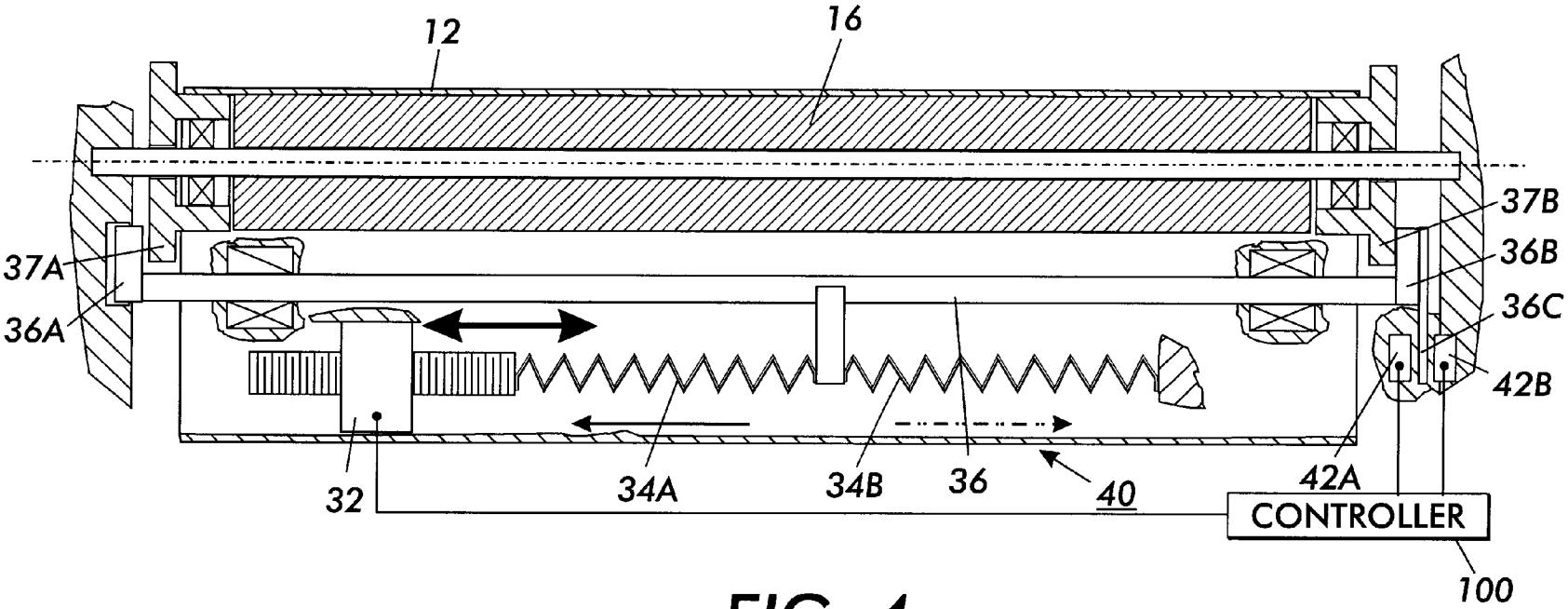

FIG. 3 is a similar view to that of FIG. 2 but illustrating an alternative exemplary integral belt tracking system utilizing a low belt force applying spring system which may be reset by a simple small motor driven lead screw actuated by a conventional belt edge position optical sensor; and FIG. 4 is a similar view to that of FIG. 3 but illustrating a slightly different alternative exemplary integral belt tracking system utilizing a low belt force applying spring system which may be controlled by the same simple small motor driven lead screw actuation by edge guide lateral deviation actuated simple end stop switches.

Describing now in further detail the exemplary embodiment with reference to the Figures, there are shown three different (but similar in several respects), embodiments 20, 30 and 40 of a belt tracking system, merely by way of some examples of the use or application of the invention.

Figure 1:
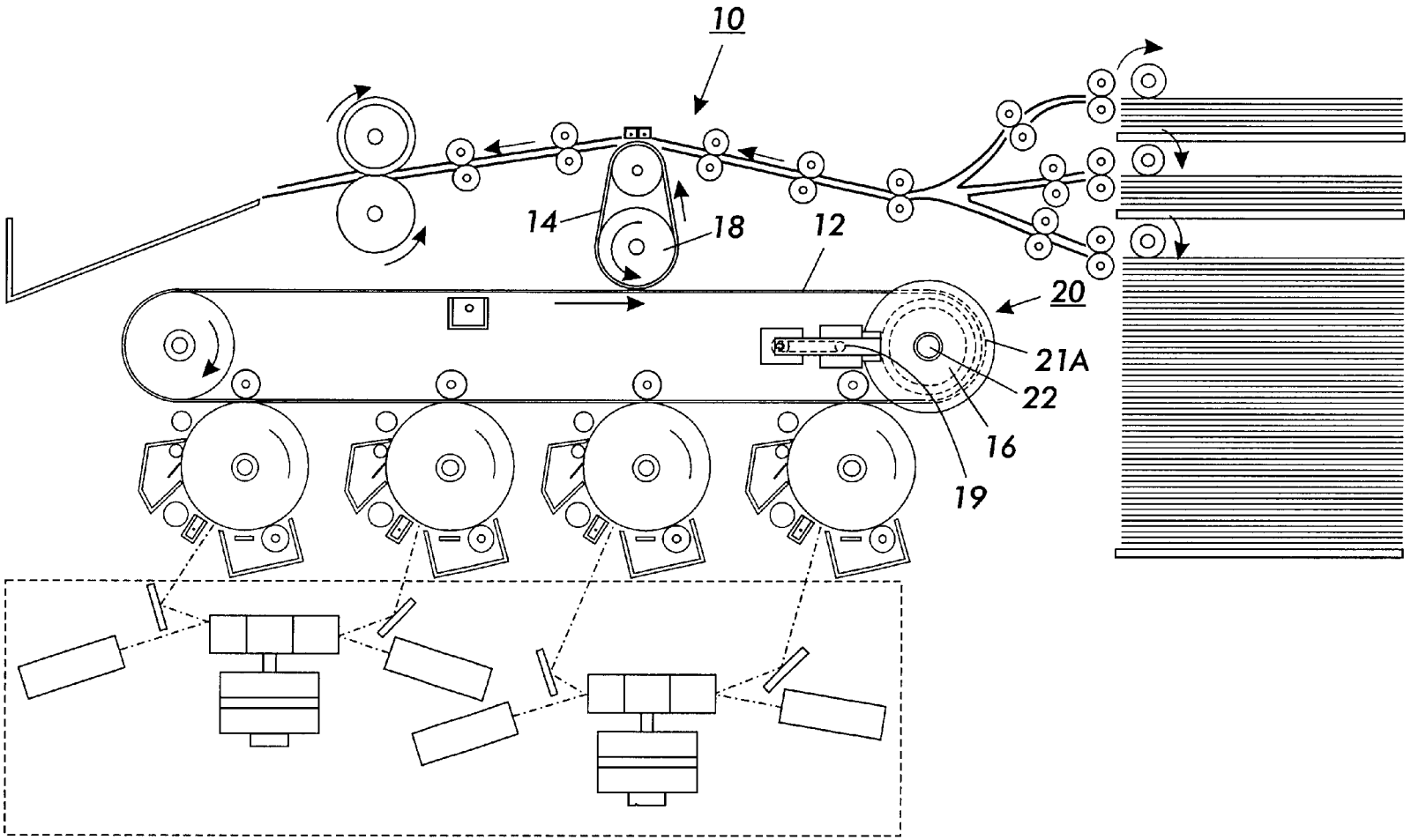
FIG. 1 is a schematic side view of an otherwise prior art example of color xerographic printer with a driven belt photoreceptor and two belt support rollers, merely as an example of where an example of the subject belt tracking system may be applied.

Further by way of background, in single-pass color printers, such as the particular example 10 of FIG. 1, the photoreceptor belt 12 and intermediate image transfer belt 14 must travel without lateral displacement in order for the color separations to overlay without color registration errors. This is normally accomplished by "active steering." As described in the above-cited references, such active steering of such image position critical (image bearing) belts such as 12 and 14 normally consists in a relatively complex mechanical tilting of the axis of at least one of their belt support rollers, such as 16 or 18 in this example. This active belt steering may be controlled in response to measuring or sensing the belt lateral position, as by known optical or other belt edge sensors, with single or multiple-array photodetectors, and/or a marks-on-belt (MOB) sensor, such as those described in Xerox Corp. U.S. Pat. No. 6,369,842, 6,275,244 or 6,300,968. The potential effect of the lack of straightness of a belt 12 or 14 edge may be compensated for by learning and storing that belt edge profile, and subtracting it from the error signal. (Conventional belt tensioning systems, such as 19, may also be employed.)

The disadvantages of active belt roller axis tilting steering systems include their complexity, a need for calibration, and the angular geometrical disturbance imparted to the belt. This last effect may even require the addition of two geometry-defining rollers on either side of the steering roller and an increased wrap around the steering system.

If such active steering is not used, simpler methods of belt edge guiding can and have been used. However, acting on the belt edge for belt tracking can causes an undesirable lateral wandering of the belt as a response to the lack of straightness of belt edge profile, and other problems discussed above. A "compliant edge guide" technique mitigates this lateral belt wandering problem but can introduce a rather large uncertainty on the average lateral position of the belt. Moreover, finite stiffness (belt lateral motion resistance) of a fixed position belt edge guide may introduce some lateral belt wandering and belt edge wear problems.

Typical disadvantages of a fixed edge guide belt lateral control system are excessive belt edge forces, lateral belt position error that is dependent on the magnitude of the belt edge profile error, and an angular geometrical disturbance imparted to the belt which is proportional to the remaining lateral position error.

Disadvantages of a compliant edge guide system can include finiteness of a spring stiffness that leads to belt wandering, or an exceedingly soft spring force that leads to an uncertain lateral belt position, with registration error and even an attendant waste of non-imageable belt width.

In contrast, the three disclosed belt tracking system embodiments 20, 30 and 40 all control the belt by means of a different, low force, movable belt edge guides control system, rather than by the above-discussed belt roller axis tilting. Instead of fixing the position of the belt edge guides, the disclosed systems provide axial movement of the belt edge guides, and act on the belt edge guides with a low, and preferably substantially constant, lateral force, the level of which is adjusted slowly, not suddenly, so as to keep the belt in the desired average lateral position. This reduces lateral image registration errors between color separations without belt profile induced belt rotation variations introducing a skew color registration error. An additional significant benefit is that the magnitude of the maximum applied belt edge force may be substantially decreased.

The general method and system of the specific embodiments here is to sense the direction of any belt lateral movement (tracking error) and to apply a slowly corrective opposing low spring force axial movement to both opposing belt edge guides (moving as a unit). The two planer belt edge guides have a constant (approximately belt width) spacing from one another. This constant spacing, and movement as a unit, of the two edge guides may be provided as illustrated by both belt edge guides being fastened adjacent the opposing ends of an axially movable (but not rotatable) central mounting shaft of the belt roller, so that the belt edge guides (desirably) do not rotate. This particular illustrated method and means for connecting the two edge guides together, to move as a unit, is a convenient way to apply the low correcting force to the side edge of the belt which needs it, via the edge guide that needs it, for the correct direction of belt lateral correction direction (in or out, or, left or right). However it will be appreciated that this particular mechanism is not the only way this could be done.

This low, but long term, belt edge lateral repositioning force from a low spring force applied to an edge guide greatly reduces the magnitude of the maximum belt edge force required to guide a belt system with a given geometry. Reducing the maximum belt edge force can also give more steering latitude, which can be traded for allowing more design, manufacturing or wear mechanical latitudes (i.e., errors in belt conicity, roll conicity, roll alignment and belt edge profile). A nearly constant, rather than intermittent, and low applied force eliminates transients in the state of the belt, which also improves belt life and lateral registration. Twisting of the belt in its plane is also avoided, since no belt supporting roller need be axially pivoted or tilted. This avoids plural color image registration errors due to changing belt skew, which otherwise may not be fully compensated for.

The disclosed system can be used in or with an otherwise conventional edge guided belt module. It may also have LLF (low lateral force) belt support rolls having laterally flexible disks, as shown in the above-cited U.S. Pat. No. 5,383,006 and elsewhere, where appropriate.

In all the belt tracking systems 20, 30 and 40 shown herein, the belt edge guides are not fixed to the machine frame or the belt roller but are movable in the lateral direction (axially with respect to the axis of their belt roller). These edge guides are acted upon by a axial movement force, which is constant in the short term (a few belt revolutions), but is caused to vary in the long term (many belt revolutions). The force magnitude is such as to keep the belt in the desired lateral position. Since the edge guide force is steady, no changes in the state of deflection of the belt will occur, and the desired pure translation of the belt material in the process direction will take place. (In this respect, the end result is similar to that of a much more complicated active steering system with two geometry-defining rollers and appropriate edge learning technique.)

In terms of control, the transient position of the belt is measured by a sensing system, which can be a simple sensor. This belt position signal may be passed through a low-pass or moving average filter, and a force direction proportional to the result may be generated and applied to the belt edge guide. It should be noted that edge guides are needed on both sides of the belt, because it is difficult to predict in which direction the belt, belt module and roller imperfections are going to cause belt walk. The edge guides, however, can be mounted rigidly together and moved as a unit, as disclosed in the examples herein.

Edge guides operate best when they do not rotate. Therefore, a good implementation of the present invention is to make the roll rotate on bearings supported by a shaft on which the edge guides are mounted. The entire assembly can then be mounted on bearings that allow lateral (axial) movement, and it can be acted upon by the force producing apparatus.

For example, in the system 20 of FIG. 2, edge guides 21A, 21B are mounted on and laterally movable on shaft 22 through roller 16 bearings 22A, 22B and end bearings 23A, 23B.

Note that in FIG. 2 only one belt edge guide is contacting the belt 16 edge at a time. In this case, the left side belt edge guide 21A. Thus, the servo 24 will apply a rightward belt direction correction to that edge guide 21A. That is, a leftward belt movement is being corrected.

In FIG. 2, the lateral belt force is produced by a servomechanism 24, controlled by an optical belt edge position sensor 25. Note that the bandwidth of this servo 24 is set very low (the time for several belt revolutions). In actuality, when the belt module unit is first started, the bandwidth of the servo can be held at a high value, so that the proper average value of the force is developed without the belt initially wandering too far. However, once the proper level is achieved, the bandwidth is decreased to the appropriate value. Alternatively, the lateral freedom of the edge guides can be restricted by stops, the purpose of which is to limit the maximum lateral excursion of the belt.

In the embodiment 30 of FIG. 3, the belt position correction actuation is implemented by means of a reversible screw motor 32 driver screw 32A; the force is provided by soft springs 34A, 34B. In order to have unidirectional force actuation and a two-way action, this bias spring system 34A, 34B is used. If the spring constant of the springs 34A, 34B is sufficiently low, as with elongated springs, the net effect can be essentially the same as in the first (servo-force) embodiment 20 of FIG. 2. That is, a low force applied over several belt revolutions for a gradual correction. The signal of the belt-edge sensor 35 is used via controller 100 to actuate the screw motor 32 with a slow reaction time, which can be achieved by a fixed and low motor 32 speed. The spring bias direction change is implemented via slide shaft 36 end cams 36A, 36B to one of the belt edge guides 37A, 37B, to internally reposition the belt roller, and thus the belt 12. Again, end stops 38A, 38B can be used to indirectly limit the maximum lateral excursion of the belt 12 while equilibrium is being sought.

In the embodiment 40 of FIG. 4, while otherwise similar to the embodiment 30 of FIG. 3, a "bang-bang" controller is implemented by a still simpler method. The motion of the edge guide control assembly 36 is limited by two stops, which also act as electric contacts 42A and 42B. 36C touching one causes the motor 32 to rotate one way and 36C touching the other causes the motor 32 to rotate oppositely. The motor speed is always the same (albeit In two different directions) and its value is chosen so that the system is stable.

In all three embodiments, the belt 12 is controlled so that it moves in pure translation, with what is essentially a simple edge-guided configuration. This enables retrofits for color use of belt modules that were designed for only black and white. Furthermore, the maximum edge force against the belt is smaller than for simple edge-guided systems due to the longer term averaging of the lateral force. The lateral force is also essentially constant all the way around the belt, thus eliminating transients in the state of the belt, and thus improving belt life and lateral registration. Also, belt rotations about axes normal to the belt plane do not take place. This is of importance for color registration because such effects cannot be readily compensated.

While the embodiments disclosed herein are preferred, it will be appreciated from this teaching that various alternatives, modifications, variations or improvements therein may be made by those skilled in the art, which are intended to be encompassed by the following claims.

What is claimed is:

1. In a printing method in which a rotatable print image bearing belt is mounted on at least one axial belt roller, and said rotatable print image bearing belt must be maintained in a desired substantially consistent lateral registration to maintain image quality; wherein lateral misregistration of said rotatable print image bearing belt is sensed and a low and substantially constant lateral positional corrective force is applied to said rotatable print image bearing belt, in response to said sensing of said lateral misregistration of said rotatable print image bearing belt, in one of the two directions axial of said axial belt roller, for at least one complete rotation of said rotatable print image bearing belt, said low and substantially constant lateral positional corrective force having a transverse force level sufficient to provide said desired substantially consistent lateral registration of said print image bearing belt, wherein said low and substantially constant lateral positional corrective force is applied indirectly through a low spring constant spring system, wherein said spring system has first and second spring components, and further including a reversible and low bandwidth drive motor acting with more force on said first spring component than said second spring component to provide said low and substantially constant lateral positional corrective force.

2. In a printing method in which a rotatable print image bearing belt is mounted on at least one axial belt roller, and said rotatable print image bearing belt must be maintained in a desired substantially consistent lateral registration to maintain image quality; wherein lateral misregistration of said rotatable print image bearing belt is sensed and a low and substantially constant lateral positional corrective force is applied to said rotatable print image bearing belt, in response to said sensing of said lateral misregistration of said rotatable print image bearing belt, in one of the two directions axial of said axial belt roller, for at least one complete rotation of said rotatable print image bearing belt, said low and substantially constant lateral positional corrective force having a transverse force level sufficient to provide said desired substantially consistent lateral registration of said print image bearing belt, wherein said print image bearing belt is mounted on said at least one axial belt roller between first and second non-rotating belt edge guides, and said low and substantially constant lateral positional corrective force is applied to at least one of said first and second non-rotating belt edge guides.

3. In a printing method in which a rotatable print image bearing belt is mounted on at least one axial belt roller, and said rotatable print image bearing belt must be maintained in a desired substantially consistent lateral registration to maintain image quality; wherein lateral misregistration of said rotatable print image bearing belt is sensed and a low and substantially constant lateral positional corrective force is applied to said rotatable print image bearing belt, in response to said sensing of said lateral misregistration of said rotatable print image bearing belt, in one of the two directions axial of said axial belt roller, for at least one complete rotation of said rotatable print image bearing belt, said low and substantially constant lateral positional corrective force having a transverse force level sufficient to provide said desired substantially consistent lateral registration of said print image bearing belt, wherein said first and second non-rotating belt edge guides are connected together by a linking system for common lateral movement in the axial direction of said axial belt roller, and said low and substantially constant transverse positional corrective force is applied thereto.

4. In a printing apparatus in which a rotatable print image bearing belt is mounted on at least one axial belt roller, and said print image bearing belt must be maintained in a desired substantially consistent lateral registration to maintain image quality, the improvement comprising:

means for sensing lateral misregistration of said rotatable print image bearing belt, and means for applying a low and substantially constant lateral positional corrective force to said image bearing belt in the axial direction of said axial belt roller for more than a complete rotation of said image bearing belt, said low and substantially constant lateral positional corrective force having a force level sufficient to maintain said desired substantially consistent lateral registration of said rotatable print image bearing belt, wherein said rotatable print image bearing belt is mounted on said at least one axial belt roller between first and second non-rotating belt edge guides, and said low and substantially constant lateral positional corrective force is applied to at least one of said first and second non-rotating belt edge guides.

5. The printing apparatus of claim 4, wherein said first and second non-rotating belt edge guides are connected together by a linking system for common lateral movement in the axial direction of said axial belt roller, and said low and substantially constant lateral positional corrective force is applied thereto.

6. In a printing method in which a rotatable print image bearing belt is mounted on at least one axial belt roller, and said print image bearing belt must be maintained in a desired substantially consistent lateral registration to maintain image quality, the improvement comprising:

sensing lateral misregistration of said rotatable print image bearing belt, and applying a low and substantially constant lateral positional corrective force to said image bearing belt in the axial direction of said axial belt roller for more than a complete rotation of said image bearing belt, said low and substantially constant lateral positional corrective force having a force level sufficient to maintain said desired substantially consistent lateral registration of said rotatable print image bearing belt, wherein said rotatable print image bearing belt is mounted on said at least one axial belt roller between first and second non-rotating belt edge guides, and said low and substantially constant lateral positional corrective force is applied to at least one of said first and second non-rotating belt edge guides.

7. The printing method of claim 6, wherein said first and second non-rotating belt edge guides are connected together by a linking system for common lateral movement in the axial direction of said axial belt roller, and said low and substantially constant lateral positional corrective force is applied thereto.

* * * * *